US005442985A

United States Patent [19]

Ito

[11] Patent Number: 5,442,985

[45] Date of Patent: Aug. 22, 1995

[54] WORK TABLE APPARATUS FOR PLATE MATERIAL PROCESSING MACHINE

[75] Inventor: Shigeru Ito, Machida, Japan

[73] Assignee: Amada Company, Limited, Japan

[21] Appl. No.: 969,284

[22] Filed: Jan. 14, 1993

[30] Foreign Application Priority Data

Jan. 17, 1992 [JP] Japan ..... 4-006866
Jan. 17, 1992 [JP] Japan ..... 4-006892
Mar. 26, 1992 [JP] Japan ..... 4-067928

[51] Int. Cl.[6] ..... B26D 7/06; B65G 15/12; B65G 15/26

[52] U.S. Cl. ..... 83/155; 83/424; 198/812

[58] Field of Search ..... 83/155, 157, 424; 198/345.2, 750, 812, 817

[56] References Cited

U.S. PATENT DOCUMENTS 2,141,574 12/1938 Wamser ..... 83/424 X
3,037,548 6/1962 Hasselquist ..... 198/812 X
3,088,581 5/1963 Rostal ..... 198/817
3,413,916 12/1968 Friz et al. ..... 100/221
4,090,391 5/1978 Hish ..... 72/422
4,821,870 4/1989 Simelunas et al. ..... 198/812

FOREIGN PATENT DOCUMENTS 2924755 1/1981 Germany .
3821806 1/1990 Germany .
2071062 9/1981 United Kingdom ..... 83/155

*Primary Examiner*—Richard K. Seidel

*Assistant Examiner*—Raymond D. Woods

*Attorney, Agent, or Firm*—Wigman, Cohen, Leitner & Myers

[57] ABSTRACT

In a work table apparatus for a plate material processing machine, a group of work supporting belts each extending in a work feed direction and divided in the direction perpendicular to the work feed direction are arranged so as to form a work table surface separated into front and rear support portions on both sides of a plate material processing section, and the work supporting belts are driven in the work feed direction in synchronism with the movement of the plate material to be processed. Therefore, no relative displacement is produced between the work support portions of the work supporting belts and the plate material to be processed. Thus, punched products of small size can be supported securely without damaging the microjoint portions of the processed products, scratching the plate material, and producing sound noise. Further, since the work support portions can be lowered selectively from the work pass line, downward projecting portions can be formed in the plate material and further the downward formed projecting portions can be supported by the lowered work support portions, thus preventing the downward deflection of the processed material. Further, since the front and rear side work support portions can be moved or urged horizontally toward each other, it is possible to effectively support the plate material by reducing as much as possible the area at which the plate material is not supported by the belts.

14 Claims, 13 Drawing Sheets

WORK TABLE APPARATUS FOR PLATE MATERIAL PROCESSING MACHINE

BACKGROUND OF THE INVENTION

1. Field of the Invention

The present invention relates to work table apparatus for a plate material processing machine such as a press forming machine, and more specifically to a work table apparatus for a plate; material processing machine which can support a plate material to be processed so as to be movable in one axis direction of coordinates.

2. Description of the Prior Art

In plate material processing machines such as press forming machines, there exists a work movement type such that a work plate material is shifted in one axis direction of coordinates along a work pass line by use of a work carriage, for instance to a predetermined position at which a press processing section composed of a pair of punch and die, for instance are arranged to process the work plate material.

In the plate material processing machine of the type as described above, the work table apparatus is so constructed as to support a work plate material at a work pass line height and further to shift the supported work plate material in one axis direction of the coordinates. In general, the work table apparatus as described above is constructed as a completely fixed work table or a partially fixed work table (such as a center table of a turret disk punch press, for instance) so as to prevent the interference between the table members and the plate material processing section, and a work plate material to be processed is slidably supported on a plurality of free bearings arranged on the Work table surface extending along the work pass line.

In the above-mentioned plate material supporting method by the prior art work table apparatus, however, since the work plate material is supported at point contacts by the free bearings, there exist various problems in that some microjoint portions of punched products (for supporting punched products so as not to be removed from the processed plate material) are caught by the free bearings and therefore removed from the processed plate material, and further the punched products of small dimensions drop passing through between the bearings, thus there inevitably exists a lower limit of the dimensions of the products to be punched. In addition, when the plate material to be processed is slid on and along the free bearings, there arise other problems in that the plate material is damaged by scratches and sound noise is inevitably produced.

Further, in the prior art work table apparatus, since the plate material to be processed is slid on and along the work table surface, the lower surface of the plate material to be supported by the work table should be flat without being formed with any downward projecting portions; that is, it has been impossible to process the work plate material so as to be formed with projections extending in the downward direction, for instance such as in the case of burring formation, lance formation, louver formation, etc.

Further, in the case of a fixed work table, an up-down mechanism is inevitably required to prevent interference of the work table members with work clamping members and an override detecting member.

Further, in the prior art work table for a plate material processing machine, a some gap exists between the work table surface and the free bearing surface, there arises a problem in that the plate material is curved downward when a great number of holes are formed simultaneously, thus deteriorating the processing precision or destroying the microjoint portions of the processed plate material.

SUMMARY OF THE INVENTION

With these problems in mind, therefore, it is the primary object of the present invention to provide a work table apparatus for a plate material processing machine, by which the plate material and punched products of small dimensions can be securely supported and conveyed, without damaging the microjoint portions of the processed products, scratching the plate material, and producing sound noise.

Further, another object of the present invention is to provide a work table apparatus for a plate material processing machine, by which downward projections can be formed in the plate material and further the downward formed projection portions can be securely supported, without producing the downward deflection of the processed plate material.

Further, still the other object of the present invention is to provide a work table apparatus for a plate material processing machine, by which the plate material can be effectively supported by reducing as small as possible the area at which the plate material is not supported.

To achieve the above-mentioned first object, the work table apparatus for a plate material processing machine having a plate material processing section (19, 23), for movably supporting a plate material (W) to be processed in a first direction along a work pass line (PL) according to the present invention comprises: (a) a group of work supporting belts (43; 45) each extending in the first direction and arranged separately in a second direction perpendicular to the first direction, so as to form a work table surface divided into a front side work support portion (43*f*; 45*f*) and a rear side work support portion (43*r*; 45*r*) on both sides of the plate material processing section; and (b) belt driving means (5; 147F, 147R) for driving said work supporting belts in the first direction of the work pass line in synchronism with movement of the plate material to be processed.

To achieve the above-mentioned second object, the work table apparatus for a plate material processing machine according to the present invention, further comprises: (a) belt supporting means (1, 45, 47, 49, 51, 53, 55, 57, 59, 61, 63, 65, 67; 149, 151, 153, 155, 157, 159, 161, 163, 156, 167, 173, 175, 177, 179) for movably supporting said work supporting belts in such a way that said work supporting belts other than the front and rear side work support portions (43*f*, 43*r*; 45*f*, 45*r*) extend away from the plate material processing section of the plate material processing machine; and (b) downward belt moving means (81, 83, 85, 87; 193, 195, 197, 199) for selectively moving the front and rear side work support portions (43*f*, 43*r*; 45*f*, 45*r*) of each of said work supporting belts (43; 45) downward away from the work pass line (PL) to support a downward formed portion (M) of the processed plate material.

Further, to achieve the above-mentioned third object, the work table apparatus for a plate material processing machine according to the present invention further comprises horizontally belt moving means (69, 71, 73, 75, 77, 79; 181, 183, 185, 187, 189, 191) (97, 99, 93, 95; 113, 115) for moving the front and rear side work support portions (43*f*, 43*r*; 45*f*, 45*r*) of said work supporting belts horizontally toward the plate material processing section to reduce gaps between two opposing inner ends of the front and rear side work support portions of said work supporting belts and between inner ends of the front or rear side work support portions thereof and the plate material processing section.

Further, in the work table apparatus for a plate material processing machine according to the present invention, each of said work supporting belts is a single belt (43); and said belt driving means is a work carriage slider (5) for supporting the plate material to be processed and linked with each of said work supporting belts.

Alternatively, in the work table apparatus for a plate material processing machine according to the present invention, each of said work supporting belts is divided into a front side work supporting belt (45F) and a rear side work supporting belt (45R); and said belt driving means includes a first belt driving motor (147F) for driving said front side work supporting belts and a second belt driving motor (147R) for driving said rear side work supporting belts, respectively.

In the work table apparatus for a plate material processing machine according to the present invention, since the work support portions of the work supporting belts support the plate material horizontally and continuously in the work movement direction in synchronism with the movement of the plate material, no relative displacement is produced between the work support portions of the work supporting belts and the plate material to be processed. Consequently, it is possible to feed the plate material without damaging the microjoint portions of the processed products, scratching the plate material, and producing sound noise.

Further, since the work support portions of the work supporting belts can be lowered selectively from the work pass line, it is possible to form downward projecting portions in the plate material and further to support the downward formed projecting portions by the lowered work support portions of the work supporting belts, thus preventing the downward deflection of the processed plate material.

Further, since the front and rear side work support portions of the work supporting belts are moved or urged horizontally toward to each other, it is possible to effectively support the plate material by reducing as small as possible the area at which the plate material is not supported by the belts.

DETAILED DESCRIPTION OF THE PREFERRED EMBODIMENTS

A first embodiment of the work table apparatus of the plate material processing machine according to the present invention will be described hereinbelow with reference to the attached drawings.

Figure 1:
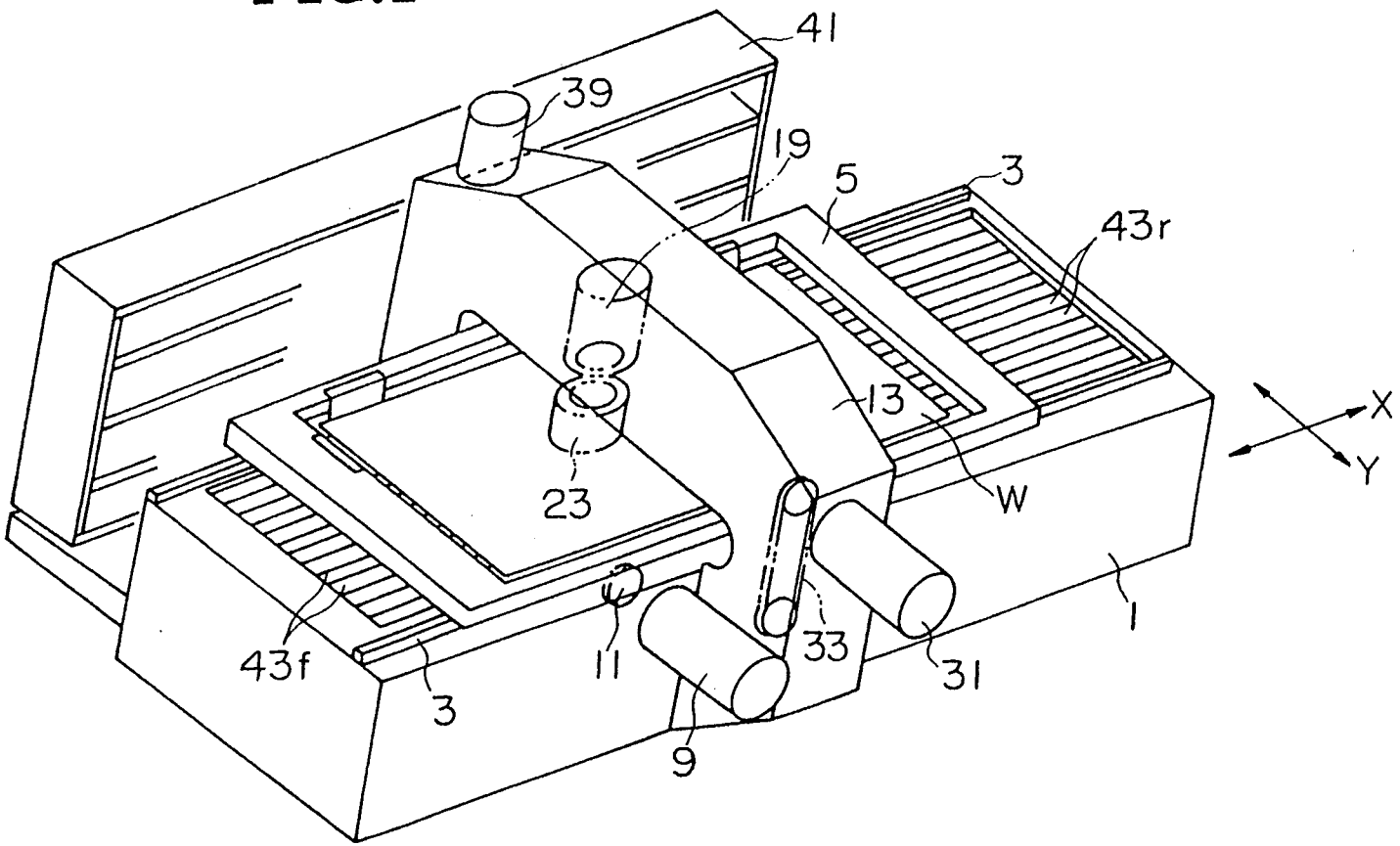
FIG. 1 is a perspective view showing a first embodiment of the work table apparatus of the plate material processing machine according to the present invention, which is applied to a press-typed double surface formation processing machine.

FIG. 1 shows the first embodiment in which the work table apparatus is applied to a press-type double surface formation processing machine. In the drawing, the double surface formation processing machine comprises a table bed member 1, two parallel arranged linear guide portions 3, and a frame-shaped work carriage slider 5. The work carriage slider 5 is movable to and fro reciprocatingly in an X-axis direction being guided by the linear guide portions 3 provided on the table bed member 1. This work carriage slider 5 detachably supports a work plate material W horizontally along the work pass line PL (see FIG. 2B) with a plurality of clamps 7 (see FIG. 2A) within the frame of the work carriage slider 5. Further, the work carriage slider 5 is moved reciprocatingly in the. X-axis direction of the coordinates by an X-axis servomotor 9 via a pinion 11 linked with the servomotor 9 and in mesh with a rack (not shown) formed at the lower bottom portion of the work carriage slider 5.

An arch-shaped frame 13 is attached to the table bed member 1 in such a way as to extend over and across the table bed member 1 in the Y-axis direction of the coordinates. Further, a lower frame 15 (see FIGS. 2A and 2B) extending in the Y-axis direction of the coordinates is provided within and across the table bed member 1 at the same horizontal position as where the arch-shaped frame 13 is provided.

An upper die carrier member 19 is attached to the arch-shaped frame 13 via two parallel arranged linear guide portions 17 (see FIG. 2B) so as to be movable in the Y-axis direction of the coordinates. In the same way, a lower die carrier member 23 is attached to the arch-shaped frame 13 via two parallel arranged linear guide portions 21 (see FIG. 2B) so as to be movable also in the Y-axis direction of the coordinates.

The upper die carrier member 19 and the lower die carrier member 23 are disposed so as to be opposed to each other in the vertical direction with the work pass line PL interposed therebetween. An upper die 25 (see FIG. 2B) such as a punch is exchangeably supported by the upper die carrier member 19, and a lower die 27 (see FIG. 2B) such as a die is also exchangeably supported by the lower die carrier member 23. Although not shown, the upper die carrier member 19 is provided with a pressure punching mechanism including a ram to drive the upper die 25. Further, the lower die carrier member 23 is provided with an up-down actuator 29 for moving the lower die 27 up and down between an up-position (at which the lower die 27 is located at the work pass line PL) and a down-position (about 30 mm downward away from the up-position).

A Y-axis servomotor 31 (see FIG. 1) is mounted on the arch-shaped frame 13. This Y-axis servomotor 31 rotates an upper ball screw 35 (see FIG. 2B) and a lower ball screw 37 (see FIG. 2B) in synchronism with each other through a belt-like synchronizing driving device 33, in order to drive the upper die carrier member 19 and the lower die carrier member 23 synchronously and reciprocatingly in the Y-axis direction of the coordinates.

Further, the upper die 25 attached to the upper die carrier member 19 and the lower die 25 attached to the lower die carrier member 23 are both rotatable about the respective vertical axes thereof so as to be indexed (divided) by an index motor 39 mounted on the arch-shaped frame 13 (see FIG. 1).

Further, a die stocker 41 is provided on one side of the table bed member 1. Various upper dies 25 and lower dies 27 stocked in the die stocker 41 are automatically detached from and attached to the upper die carrier member 19 and the lower die carrier member 23, respectively by an automatic die exchanging mechanism (not shown).

Figure 2A:
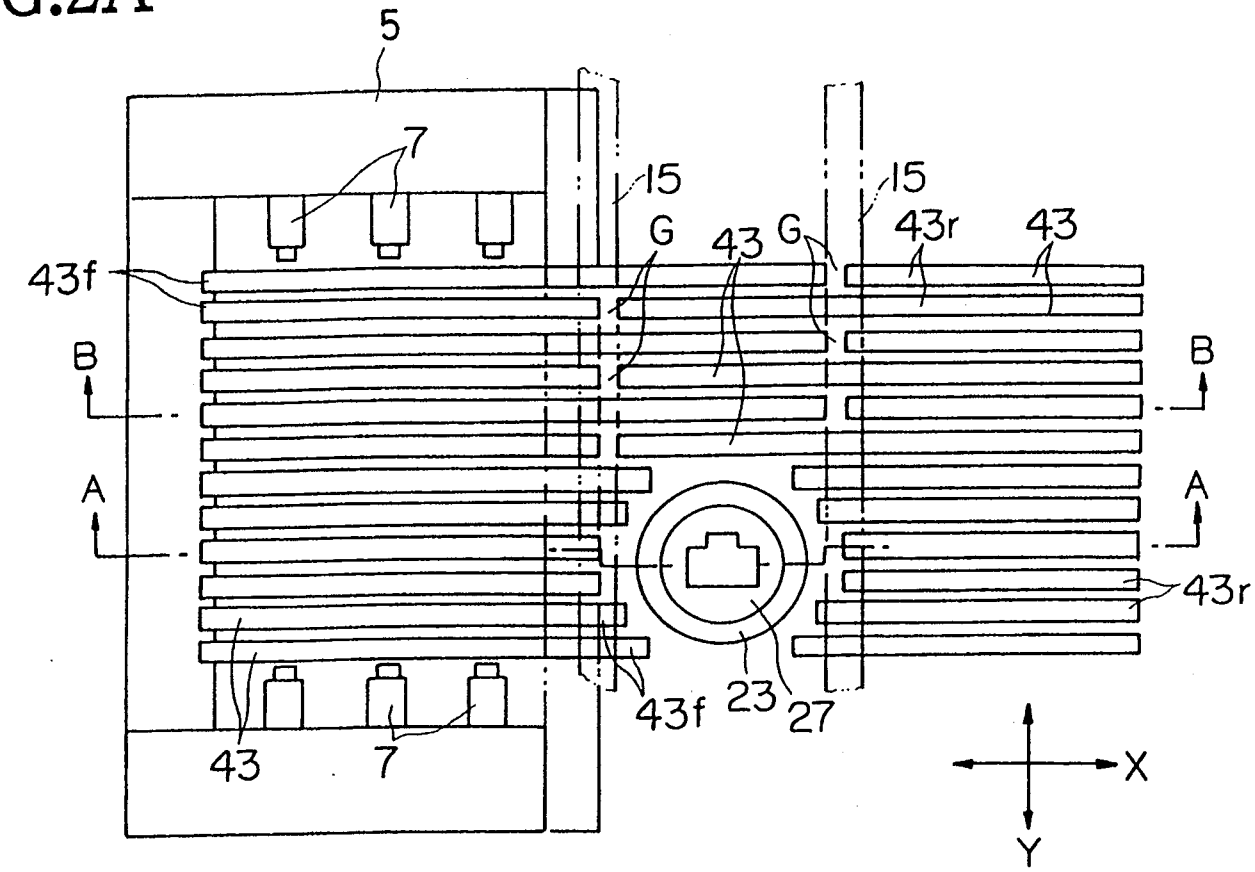
FIG. 2A is a partial plane view showing the first embodiment shown in FIG. 1.
Figure 2B:
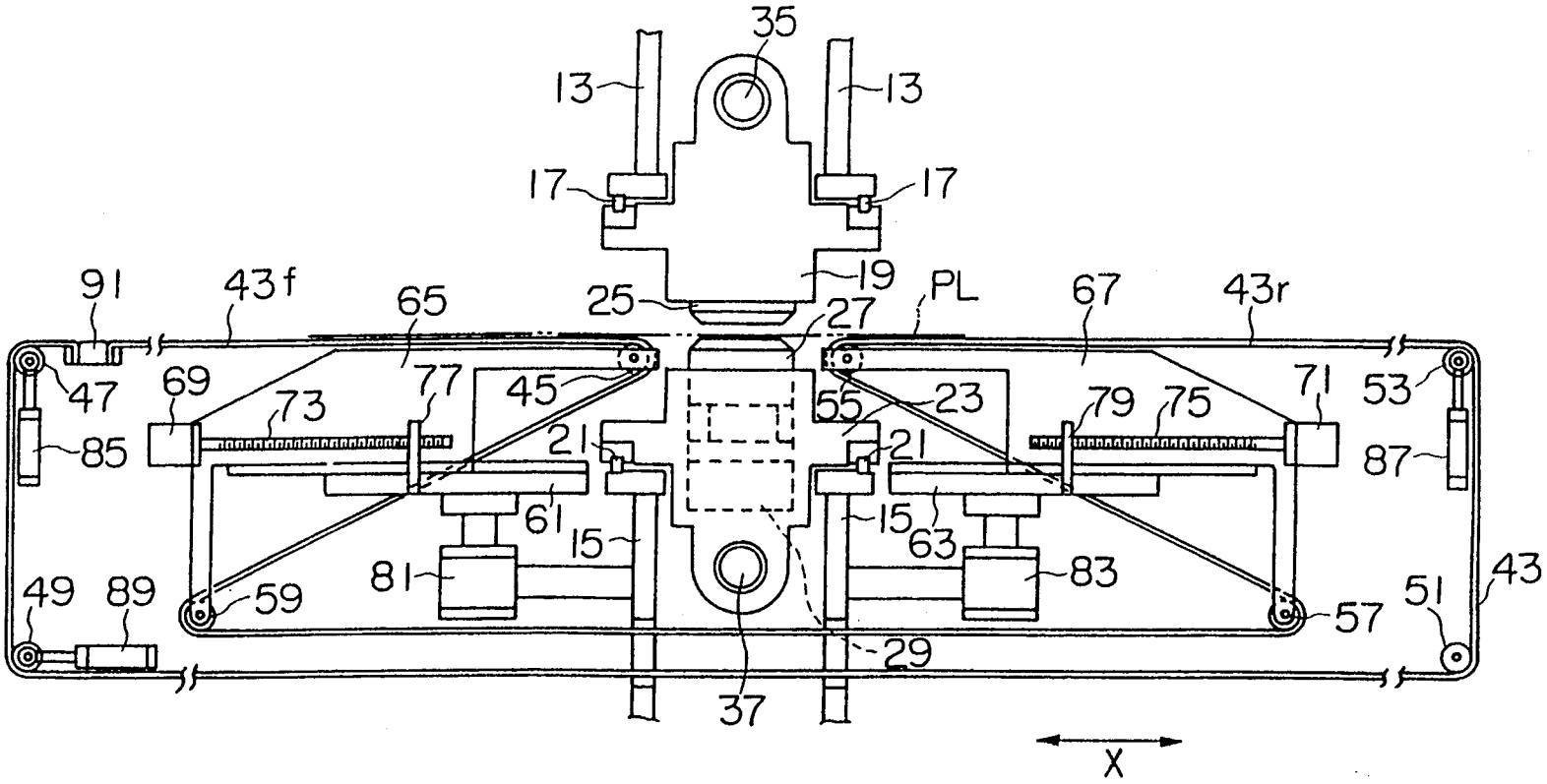
FIG. 2B is a cross-sectional view taken along the line A—A shown in FIG. 2A.
Figure 2C:
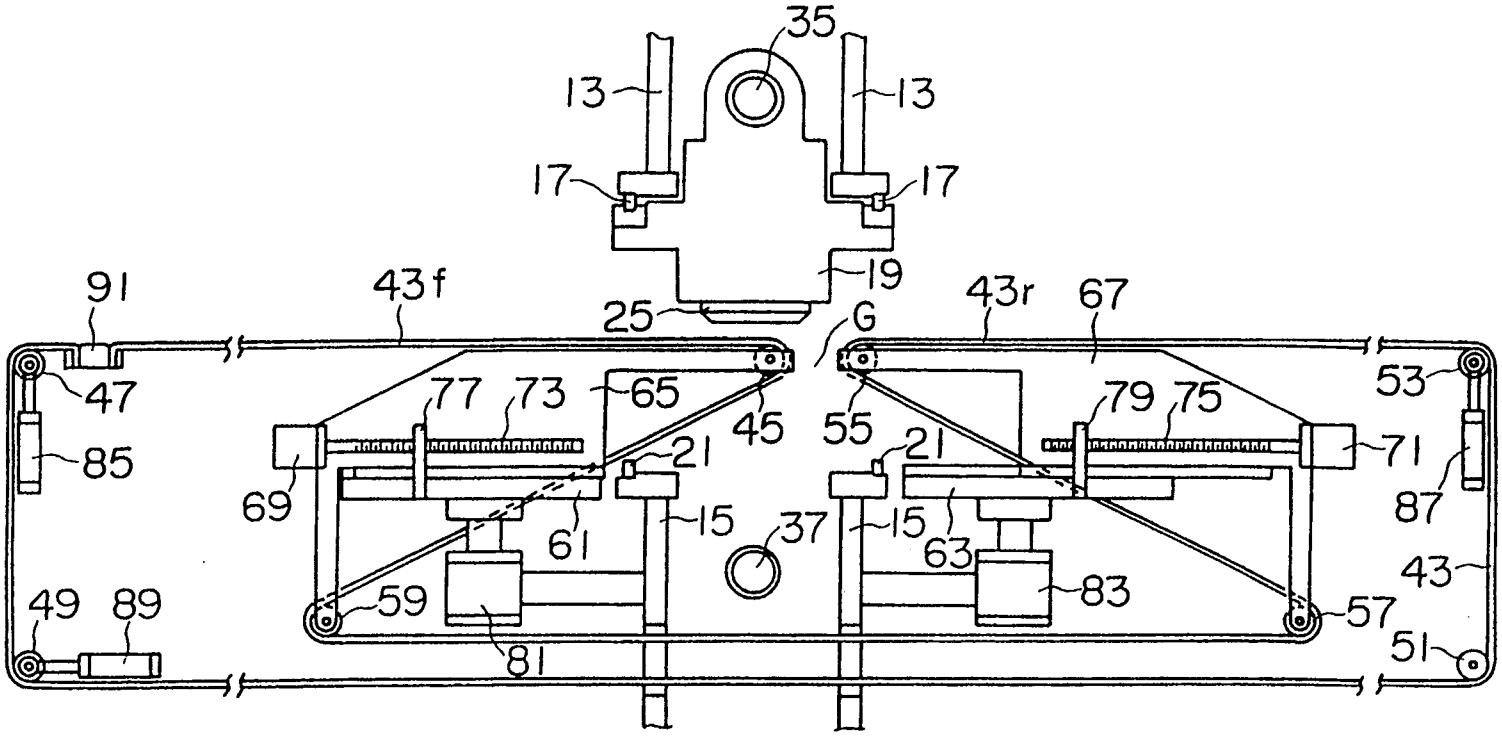
FIG. 2C is a cross-sectional view taken along the line B—B shown in FIG. 2A.

With reference to FIGS. 2A to 2C, the essential portions of the work table apparatus will be described in further details hereinbelow. The work table apparatus is provided with a plurality of work supporting belts 43 arranged within the table bed member 1 being divided in the Y-axis direction perpendicular to the X-axis direction along which the plate material to be processed W is moved by the work carriage slider 5. In other words, a group of work supporting belts 43 are arranged at regular intervals and in parallel to each other in the Y-axis direction of the coordinates.

The work supporting belts 43 are endless belts having a predetermined width and formed of flexible belt-shaped material such as rubber respectively, and are driven round via 8 pulleys 45, 47, 49, 51, 53, 55, 57, and 59, respectively.

In more detail, the pulleys 45 and 59 of each of the work supporting belts 43 are rotatably supported by a movable pulley support member 65 disposed on the left side (in FIGS. 2B and 2C) of the lower frame 15 so as to be shiftable in the X-axis direction of the coordinates along a fixed guide member 61. In the same way, the pulleys 55 and 57 of each of the work supporting belts 43 are rotatably supported by a movable pulley support member 67 disposed on the right side (in FIGS. 2B and 2C) of the lower frame 15 so as to be shiftable in the X-axis direction of the coordinates along a guide member 63. The pulleys 47 and 49 are rotatably supported on the left side of the table bed member 1 (in FIGS. 2B and 2C), and the pulleys 53 and 51 are rotatably supported on the right side of the table bed member 1 (in FIGS. 2B and 2C). The respective work supporting belts 43 are disposed extending along the work pass line PL between the pulleys 45 and 47 and between the pulleys 55 and 53, respectively so as to form a work table surface movable in the X-axis direction of the coordinates. Here, the area of each of the work supporting belts 43 between the pulleys 45 and 47 is referred to as a front side work support portion **43*f* and the area of each of the work supporting belts 43 between the pulleys 55 and 53 is referred to as a rear side work support portion 43*r***.

Each of the movable pulley support members 65 and 67 is disposed for each of the work supporting belts 43. In the same way, a pair of the pulleys 45 and 59 are disposed for each movable pulley support member 65 and a pair of the pulleys 55 and 57 are disposed for each movable pulley support member 67. Each of the movable pulley support members 65 and 67 is provided with a servomotor 69 or 71, respectively. Each servomotor 69 or 71 includes a ball screw 73 or 75 extending in the X-axis direction of the coordinates and in mesh with a nut member 77 or 79 fixed to each guide member 61 or 63, respectively.

Therefore, when the movable pulley support member 65 or 67 is moved in the X-axis direction of the coordinates, the pulley 45 or 55 can be also shifted in the same X-axis direction, in order to adjust the length of the front side work support portion **43*f* or the rear side work support portion 43*r***, respectively along the X-axis direction thereof.

The movable pulley support members 65 and 67 are shifted by the respective servomotors 69 and 71 in the X-axis direction, in order to prevent the interference of the movable pulley support members 65 and 67 with the lower die carrier member 23 caused when the lower die carrier member 23 is moved upward in the Y-axis direction. FIG. 2B shows the state where the two opposing pulleys 45 and 55 of the work supporting belts 43 arranged near the lower die carrier member 23 are shifted a distance away from each other in the X-axis direction with the lower die carrier member 23 interposed between the front side and rear side work support portions **43*f* and 43*r* of the work supporting belts 43. On the other hand, FIG. 2C shows the state where the two opposing pulleys 45 and 55 of the work supporting belts 43 are arranged close to each other without interposing the lower die carrier member 23 between the front side and rear side work support portions 43*f* and 43*r* of the work supporting belts 43**.

Further, as shown in FIG. 2C, there exist some gaps G between the two opposing pulleys 45 and 55 at which the work supporting belts 43 are not present. In order to prevent the plate material W to be processed from dropping through the gaps G, in this embodiment, the -two adjacent work supporting belts 43 are arranged alternately in zigzag fashion along the Y-axis direction so as to be shifted in the X-axis direction, as shown in FIG. 2A, so that the gaps G formed between the two front side and rear side work support belts 43*f* and 43*r* will not be formed continuously in a straight line along the Y-axis direction.

Therefore, when the movable pulley support members 65 and 67 are shifted in the X-axis direction, since the two opposing pulleys 45 and 55 are also shifted in the same X-axis direction, the distances between the two opposing pulleys 45 and 55 can be adjusted in the X-axis direction. Further, the work supporting belts 43 between the pulleys 45 and 59 and between the pulleys 55 and 57 are moved around downward away from the lower die carrier member 23.

The guide members 61 and 63 are linked with up-down hydraulic cylinder devices 81 and 83, respectively so as to be mowed up and down. The pulleys 47 and 53 are linked with other up-down hydraulic cylinder devices 85 and 87, respectively also so as to be moved up and down. By moving the guide members 61 and 63 and the pulleys 47 and 53 synchronously with these up-down hydraulic cylinder devices 81, 83 and 85, 87, respectively. It is possible to move vertically the respective front side work support portions 43*f* and the respective rear side work support portions 43*r* of the work supporting belts 43 selectively, between an upward position corresponding to the pass line PL and a downward position about 30 mm downward away from the upward position, under the condition that the respective work supporting belts 43 are kept horizontally.

Each of the respective pulleys 49 is linked to a belt tension maintaining hydraulic cylinder 89 so as to be shiftable in the X-axis direction. Therefore, the tension of each of the respective work support belts 43 can be kept at a predetermined constant value by the displacement in the X-axis direction of each pulley 49 caused by the belt tension maintaining hydraulic cylinder 89, irrespective of the movements of the other pulleys 45, 47, 51, 53, 55 and 57.

Each of the work support belts 43 is connected to the work carriage slider 5 via a link portion 91 formed along the vertical direction of the work support belts 43. Accordingly, when the work carriage slider 5 moves in the X-axis direction, each work support belt 43 travels along the pulleys 45, 47, 49, 51, 53, 57 and 59, respectively together with the work carriage slider 5. In other words, the front side work support portions 43*f* and the rear side work support portions 43*r* of the respective work support belts 43 move in the X-axis direction in synchronism with the movement of the work carriage slider 5 along the same X-axis direction at the same speed.

The operation of the double surface formation processing machine provided with the work table apparatus constructed as described above will be .described hereinbelow.

First, a plate material W to be processed is set to the work carriage slider 5 with the use of the work clamps 7. Therefore, the plate material W to be processed is fixed to the work carriage slider 5 and further brought into contact with the surfaces of the front side work support portions 43*f* and the rear side work support portions 43*r* of the respective work support belts 43 positioned at the upward position. That is, the plate material W mounted on the respective front and rear side work support portions 43*f* and 43*r* is supported horizontally at a height position of the work pass line PL.

When the work carriage slider 5 is moved in the X-axis direction by the X-axis servomotor 9, the plate material W supported by the work carriage slider 5 is also moved in the X-axis direction along the work pass line PL. When the upper die carrier member 19 and the lower die carrier member 23 are moved in the Y-axis direction by the Y-axis servomotor 31, the upper die 25 of the upper die carrier member 19 and the lower die 27 of the lower die carrier member 23 are also moved in the Y-axis direction to locate both the upper and lower dies 25 and 27 at a predetermined position relative to the plate material W at which the plate material can be processed such as punching.

When the work carriage slider 5 is being moved in the X-axis direction, since the respective work supporting belts 43 travel along the pulleys 45, 47, 49, 51, 53, 57 and 59 together with the movement of the work carriage slider 5 in the X-axis direction, the front side work support portions 43*f* and the rear side work support portions 43*r* of the respective work support belts 43 move in the same X-axis direction at the same speed in synchronism with the movement of the plate material W supported by the work carriage slider 5.

In other words, when the plate material W is moved in the X-axis direction, since no relative displacement is produced between the plate material W and the work table surface of the front and rear side work support portions 43*r* and 43*r* of the work supporting belts 43 on which the plate material W is supported, the plate material W will not slide on and along the work table surface (the front and rear side work support portions 43*f* and 43*r*), thus it being possible to prevent the plate material W from being scratched.

Further, when the plate material W is moved in the X-axis direction, since the lower die 27 of the lower die carrier member 23 is moved down below the work pass line PL by the die up-down actuator 29, it is possible to prevent the contact between the plate material W and the lower die 27, thus preventing the plate material W from being scratched.

The front side work support portions 43*f* and the rear side work support portions 43*r* of the respective work supporting belts 43 are kept horizontally at the upward position of the pass line PL when the plate material W is being moved and also processed. Therefore, it is possible to prevent the plate material W is curved downward by the weight of a plurality of punching dies, thus it being possible to prevent the processing precision from being degraded or the microjoint portions from being damaged.

Figure 4A:
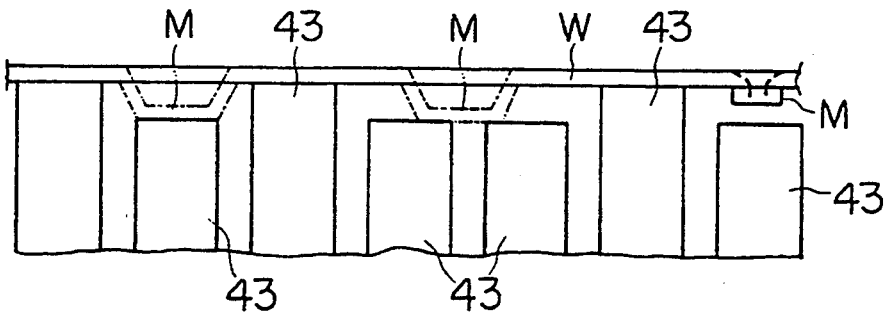
FIG. 4A is a partial enlarged side view for assistance in explaining a first example of the downward formed projections processed by the work table apparatus of the plate material processing machine according to the present invention.

When the plate material W is processed for burring formation, lance formation, louver formation, etc., the lower die 27 fixed to the lower die carrier member 23 is lowered by the die up-down actuator 29 by a height distance corresponding to that of the downward formed portion M. Further, after the downward formation processing has been completed, as depicted in FIG. 4A, the respective guide members 61 and 63 and the respective pulleys 47 and 53 are moved down by the respective up-down hydraulic cylinder devices 81, 83 and 85, 87, respectively belonging to the respective work supporting belts 43 corresponding to positions of the downward formed portions M (due to burring, lance, louver, etc,) of the plate material W. Consequently, it is possible to prevent the interference between the front and rear side work support portions 43*f* and 43*r* of the work supporting belts 43 and the downward formed portions M. The work supporting belts 43 corresponding to the positions of the downward formed portions M can be selected and designated in accordance with an NC program previously prepared before the downward formation processing.

As far as the plate material W clamped in the work carriage slider 5 is not removed from the work carriage slider 5, the plate material W is not dislocated from the front and rear side work support portions 43*f* and 43*r* of the work supporting belts 43 in both the X- and Y-axis directions. After the front and rear side work support portions 43*f* and 43*r* of the work supporting belts 43 corresponding to the positions of the downward formed portions M are lowered, these lowered portions 43*f* and 43*r* of the work supporting belts 43 support the downward formed portions M of the plate material W. In this case, when the downward formed portions M of the plate material W are being processed, since the front and rear side work support portions 43*f* and 43*r* of the work supporting belts 43 corresponding to the positions other than the downward formed portions M support the plate material W, it is possible to stably support the plate material W horizontally at a height position of the work pass line PL.

Figure 4B:
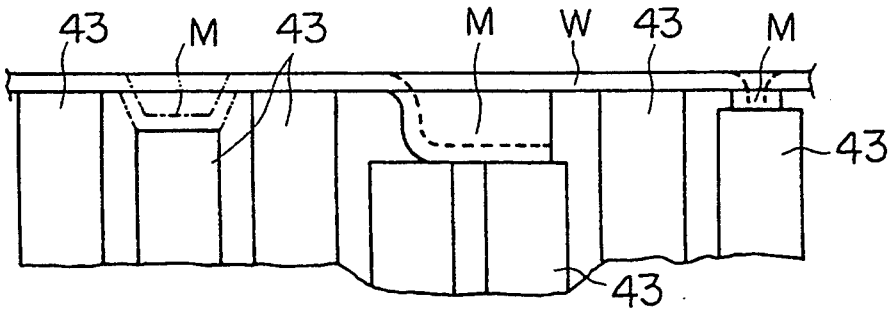
FIG. 4B is a similar partial enlarged side view for assistance in explaining a second example of the downward formed projections processed by the work table apparats of the plate material processing machine according to the present invention.

The downward distances of the front and rear side work support portions 43*f* and 43*r* of the work supporting belts 43 corresponding to the positions of the downward formed portions M can be determined according to the respective formation heights of the corresponding downward formed portions M as depicted in FIG. 4B. In this case, the downward formed portions M are supported by both the front and rear side work support portions 43*f* and 43*r*.

Further, when the plate material W is processed so as to form upward burring, lance, louver, etc., it is of course unnecessary to move down the front and rear side support portions 43*f* and 43*r* of the work supporting belts 43.

When the upper die carrier member 19 and the lower die carrier member 23 are moved in the Y-axis direction by the Y-axis servomotor 31, the movable pulley support members 65 are moved in the leftward direction in FIG. 2B by the servomotor 69 and further the movable pulley support members 67 are moved in the rightward direction in FIG. 2B by the servomotor 71, so that the lower die carrier member 23 can move through between the pulleys 45 of the front side work support portions 43*f* of the work supporting belts 43 moved in the leftward direction and the pulleys 55 of the rear side work support portions 43*r* of the work supporting belts 43 moved in the rightward direction.

In other words, since the spaces between the pulleys 45 of the front side work support portions 43*f* and the pulleys 55 of the rear side word support portions 43*r* can be increased to such an extent that the lower die carrier member 23 can pass therebetween, it is possible to move the lower die carrier member 23 in the Y-axis direction for tool exchange, for instance without being subjected to the interference with the front and rear side work support portions 43*f* and 43*r* of the work supporting belts 43.

After the lower die carrier member 23 has been moved in the Y-axis direction, the movable pulley support members 65 and 67 for the work supporting belts 43 moved to widen the spaces between the pulleys 45 and 55 are both returned to the original positions, respectively, so that the spaces between the pulleys 45 of the front side work support portions 43*f* and the pulleys 55 of the rear side work support portions 43*f* are returned to the original gap G.

Figure 3A:
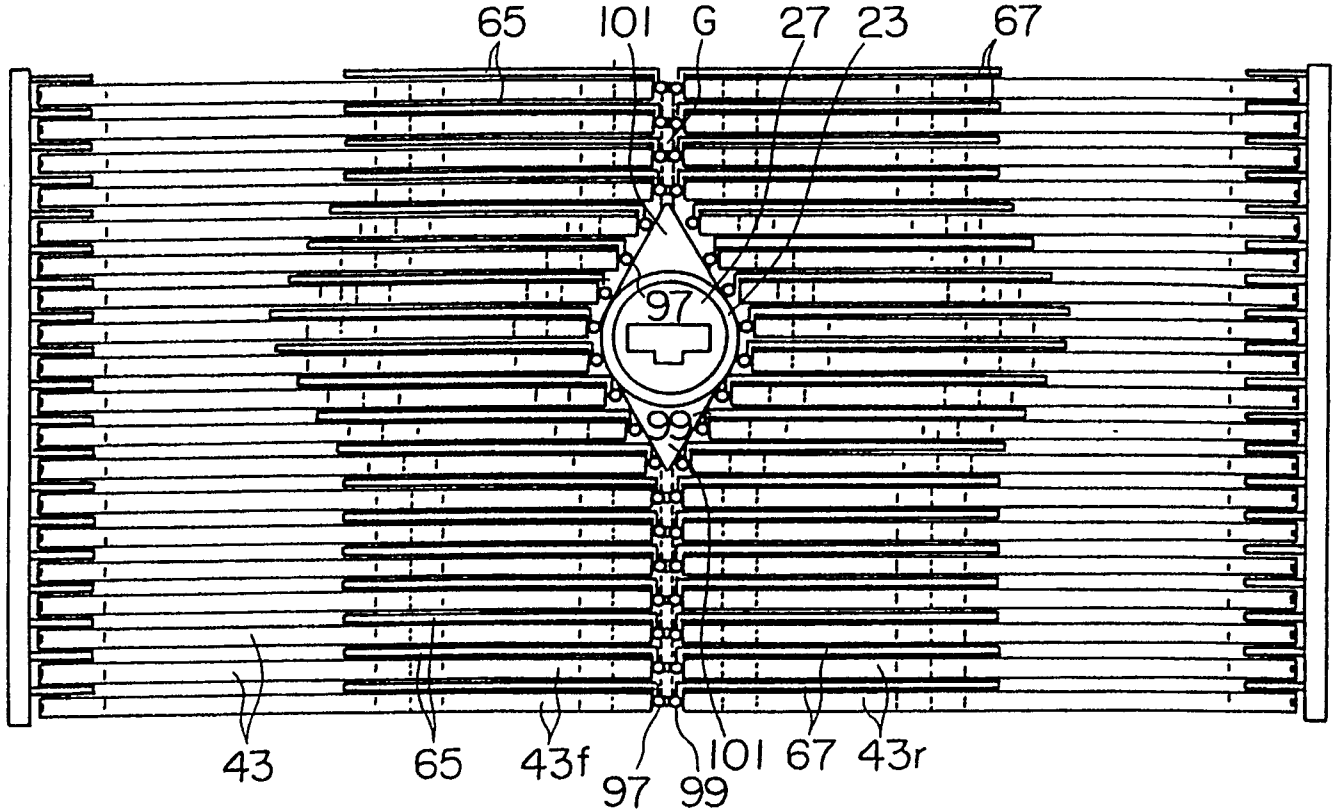
FIG. 3A is a plane view showing a second embodiment of the work table apparatus of the plate material processing machine according to the present invention.

A second embodiment of the work table apparatus of the present invention will be described hereinbelow with reference to FIGS. 3A to 3C. The structural features and the functional effects of this second embodiment are substantially the same as with the case of the first embodiment previously described, except that two respective movable pulley support members 65 and 67 are urged toward each other by two respective springs 93 and 95 so that the spaces can be reduced between the pulleys 45 of the front side work support portions 43*f* of the work supporting belts 43 and the pulleys 55 of the rear side work support portions 43*r* of the work supporting belts 43. Therefore, the same reference numerals have been retained for the similar parts or sections which have the same functions without repeating any detailed description thereof.

Figure 3B:
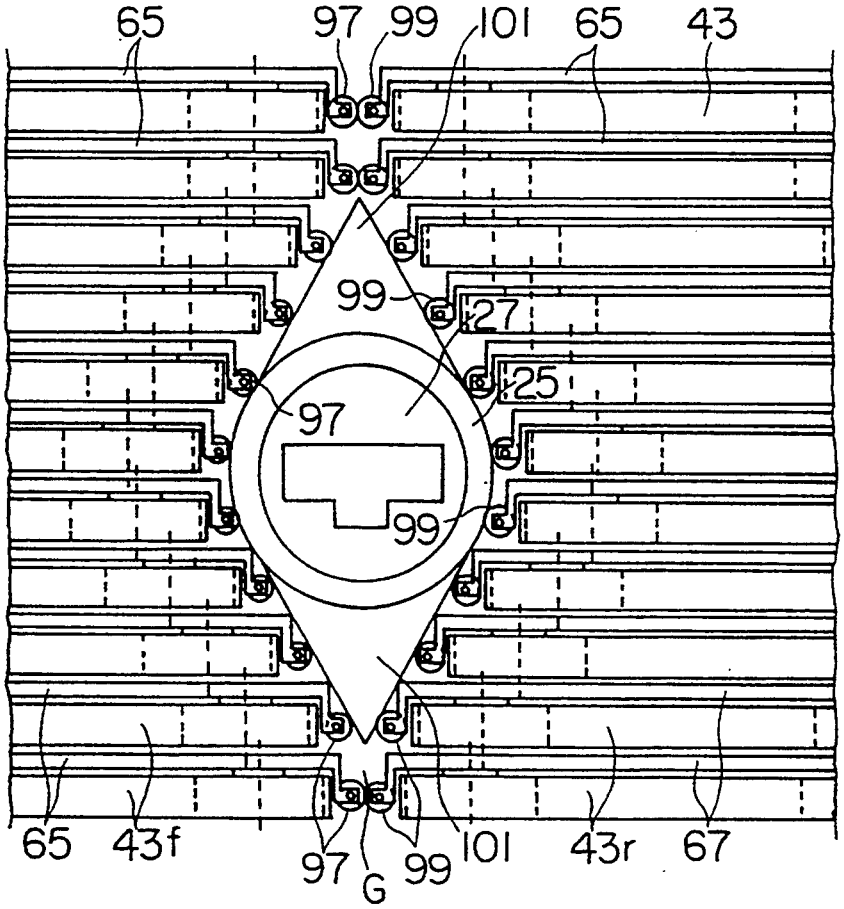
FIG. 3B is an enlarged partial plan view showing the essential portion of the second embodiment shown in FIG. 3A.
Figure 3C:
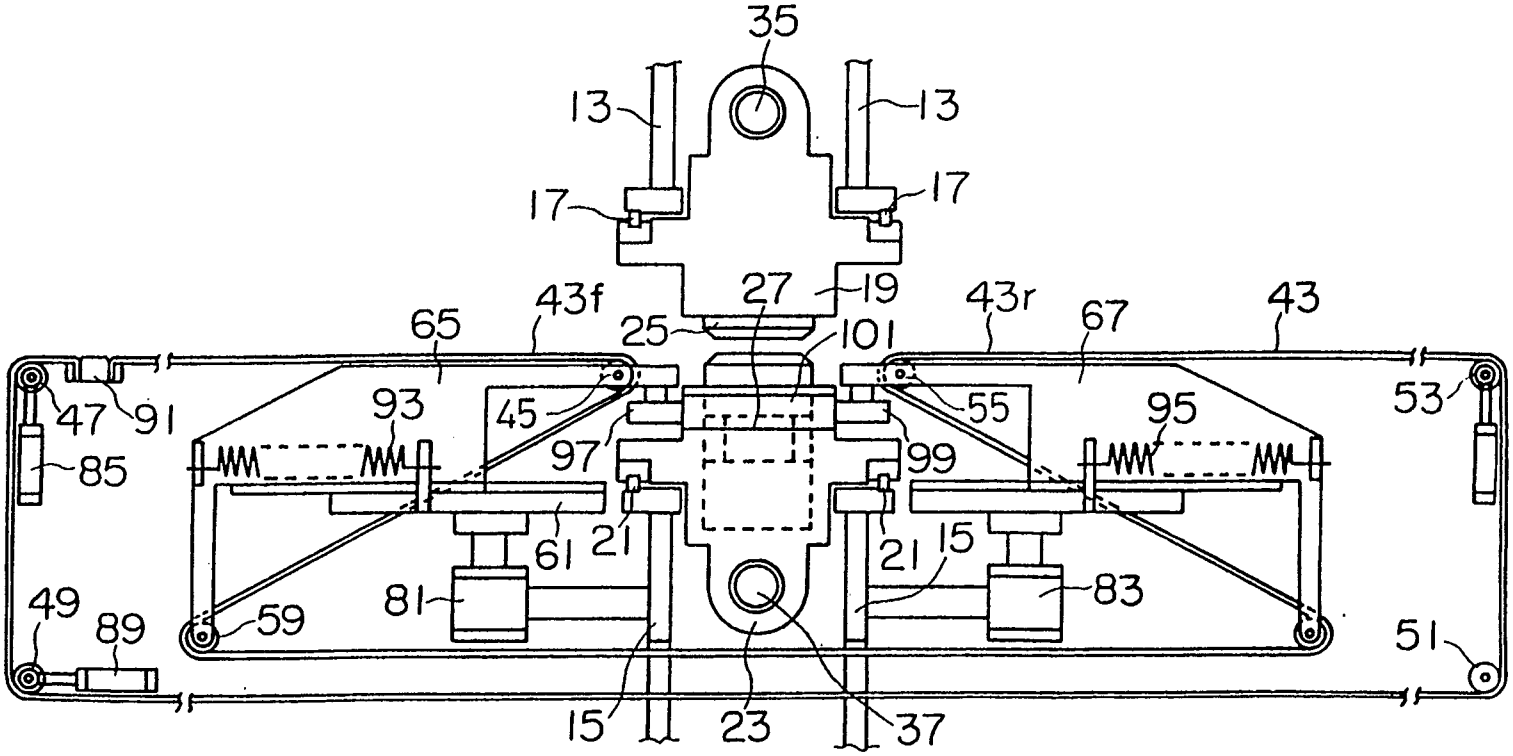
FIG. 3C is a longitudinal cross-sectional view showing the essential portion of the second embodiment shown in FIG. 3A.

In this embodiment, a cam follower roller 97 is rotatably attached to each of the inner ends of the movable pulley support members 65 and a cam follower roller 99 is rotatably attached to each of the inner ends of the movable pulley support members 67, as shown in FIG. 3C. Further, a tapering rhombical (diamond-shaped) cam member 101 extending in the Y-axis direction is fixedly attached to the lower die carrier member 23 as shown in FIG. 3B. The respective cam follower rollers 97 and 99 are brought into contact with the respective side portions of the two equilateral triangles of the rhombical cam member 101 by the elastic forces of the respective springs 93 and 95.

In this embodiment, the cam follower rollers 97 and 99 belonging to the work supporting belts 43 corresponding to the positions at which the lower die carrier member 23 is not present are directly brought into contact with each other by the elastic forces of the springs 93 and 95, so that the spaces between the pulleys 45 of the front side work support portions 43*f* and the pulleys 55 of the rear side work supporting portions 43*r* are kept at the minimum gaps, as shown in FIG. 3B.

In contrast with this, the respective cam follower rollers 97 and 99 belonging to the work support belts 43 corresponding to the positions at which the lower die carrier member 23 is present are brought into contact with the circumferential wall surface of the lower die carrier member 23 and the side portions of the equilateral triangles of the cam member 101 by the elastic forces of the springs 93 and 99, so that the lower die carrier member 23 is located between the pulleys 45 of the front side work support portions 43*f* of the work supporting belts 43 and the pulleys 55 of the rear side work support portions 43*r* thereof, also as shown in FIG. 3B.

When the upper die carrier member 19 and the lower die carrier member 23 are moved in the Y-axis direction by the Y-axis servomotor 31, the cam member 101 is moved in contact with the cam follower rollers 97 of the movable pulley support members 65 and the cam follower rollers 99 of the movable pulley support members 67, without being removed away from the respective cam follower rollers 97 and 99.

Since the vertical width of the cam surface of the cam member 101 is sufficiently wide (e.g. 35 to 40 mm), the spaces between the pulleys 45 of the front side work support portions 43*f* of the work supporting belts 43 and the pulleys 55 of the rear side work support portions 43*r* thereof can be maintained even when the lower die carrier member 23 is moved, so that it is possible to move the lower die carrier member 23 in the Y-axis direction without any interference of the lower die carrier member 23 with the front and rear side work support portions 43*f* and 43*r* of the work supporting belts 43.

Further, in this embodiment, since the front side work support members 43*f* and the rear side work support members 43*r* can be moved down independently for each work supporting belt 43, it is possible to realize the same functions and to obtain the same effects as with the case of the first embodiment when the plate material W is processed for downward formation.

In both the above-mentioned embodiments, the work supporting belts 43 can be initially set as follows: When the work carriage slider 5 is set to an initial position as shown in FIG. 2A, for instance, since the respective work supporting belts 43 are all located under the same phase conditions with respect to each other, the work supporting belts 43 are arranged by moving down the belts 43 until through holes formed in the respective belts 43 are fitted to urethane-formed free bearings provided at the height positions corresponding to the work pass line PL, for instance. Alternatively, it is also possible to set the initial positions of the work supporting belts 43 by use of brush members provided perpendicular to the respective two adjacent work supporting belts 43.

In the above-mentioned embodiments, the plate material W to be processed is fixed to the work carriage slider 5 with the use of the clamps and then moved in the X-axis direction. Without being limited thereto, however, it is possible to move the plate material W directly mounted on the front and rear side work support portions 43*f* and 43*r* of the work supporting belts 43 in the X-axis direction, without use of the work carriage slider 5. In this case, the work supporting belts 43 are directly moved by the X-axis servomotor 9, respectively.

A third embodiment of the work table apparatus of the plate material processing machine according to the present invention will be described hereinbelow with reference to the attached drawings.

Figure 5:
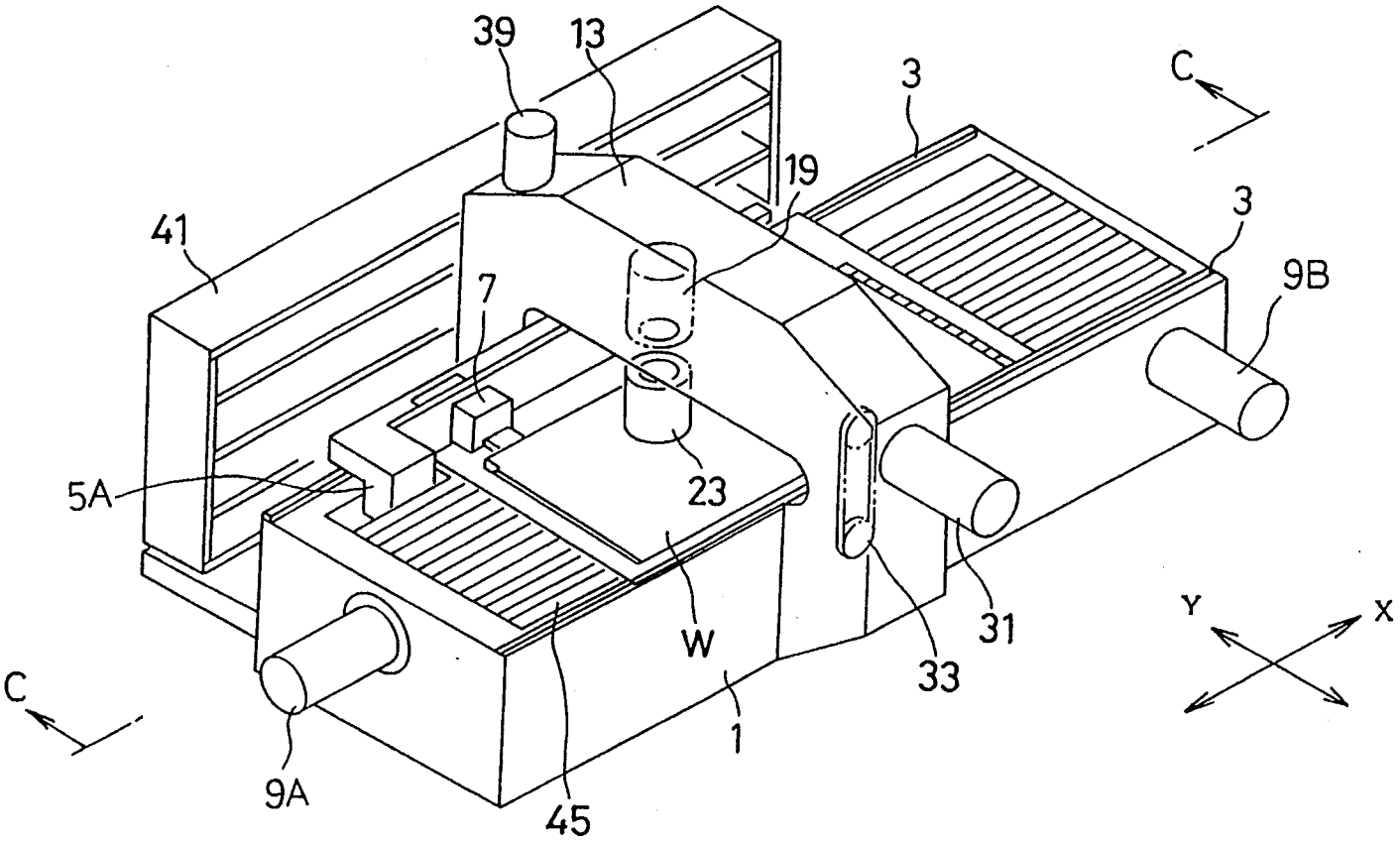
FIG. 5 is a perspective view showing a third embodiment of the work table apparatus of the plate material processing machine according to the present invention, which is applied to a press-typed double surface formation processing machine.

FIG. 5 shows the third embodiment in which the work table apparatus is applied to a press-type double surface formation processing machine. In the drawing, the double surface formation processing machine comprises a table bed member 1, a linear guide portions 3, and a frame-shaped work carriage slider 5A. The work carriage slider 5A is movable to and fro reciprocatingly along an X-axis direction being guided by the linear guide portions 3 provided on the table bed member 1. This work carriage slider 5A detachably supports a work plate material W horizontally along the work pass line PL (see FIG. 6B) with a plurality of clamps 7 (see FIG. 6A) within the frame of the work carriage slider 5A. Further, the work carriage slider 5A is moved reciprocatingly in the X-axis direction of the coordinates by two X-axis servomotors 9A and 9B, respectively via two pinions (not shown) linked with these two servomotors and in mesh with a rack (not shown) formed at the lower bottom portion of the work carriage slider 5A, respectively.

An arch-shaped frame 13 is attached to the table bed member 1 in such a way as to extend over the table bed member 1 in the Y-axis direction of the coordinates. Further, a lower frame 15 (see FIGS. 6A and 6B) extending in the Y-axis direction of the coordinates is provided within and across the table bed member 1 at the same horizontal position as where the arch-shaped frame 13 is provided.

An upper die carrier member 19 is attached to the arch-shaped frame 13 via linear guide portions 17 (see FIG. 6B) so as to be movable in the Y-axis direction of the coordinates. In the same way, a lower die carrier member 23 is attached to the arch-shaped frame 13 via linear guide portions 21 (see FIG. 6B) so as to be movable also in the Y-axis direction of the coordinates.

The upper die carrier member (e.g. punch head) 19 and the lower die carrier member (e.g. die head) 23 are disposed so as to be opposed to each other in the vertical direction with the work pass line PL interposed therebetween. An upper die 25 (see FIG. 6B) such as a punch is exchangeably supported by the upper die carrier member 19, and a lower die 27 (see FIG. 6B) such as a die is also exchangeably supported by the lower die carrier member 23. Although not shown, the upper die carrier member 19 is provided with a pressure punching mechanism including a ram to drive the upper die 25. Further, the lower die carrier member 23 is provided with an up-down actuator 29 for moving the lower die 27 up and down between an up-position (at which the lower die 27 is located at the work pass line PL) and a down-position (about 30 mm downward away from the up-position). Here, the above-mentioned distance of 30 mm downward away from the pass line PL is an addition of a maximum height (25 mm) of downward formed projections to be formed in the plate material W and an additional coverage (5 mm).

A Y-axis servomotor 31 (see FIG. 5) is mounted on the arch-shaped frame 13. This Y-axis servomotor 31 rotates an upper ball screw 35 (see FIG. 6B) and a lower ball screw 37 (see FIG. 6B) in synchronism with each other through a belt-like synchronism driving device 33, in order to drive the upper die carrier member 19 and the lower die carrier member 23 synchronously and reciprocatingly in the Y-axis direction of the coordinates.

Further, the upper die 25 attached to the upper die carrier member 19 and the lower die 25 attached to the lower die carrier member 23 are both rotated about the respective vertical axes thereof so as to be indexed (divided) by an index motor 39 mounted on the arch-shaped frame 13 (see FIG. 5).

Further, a die stocker 41 is provided on one side of the table bed member 1. Various upper dies 25 and lower dies 27 stocked in the die stocker 41 are automatically detached and attached exchangeably from and to the upper die carrier member 19 and the lower die carrier member 23, respectively by an automatic die exchanging mechanism (not shown).

Figure 6A:
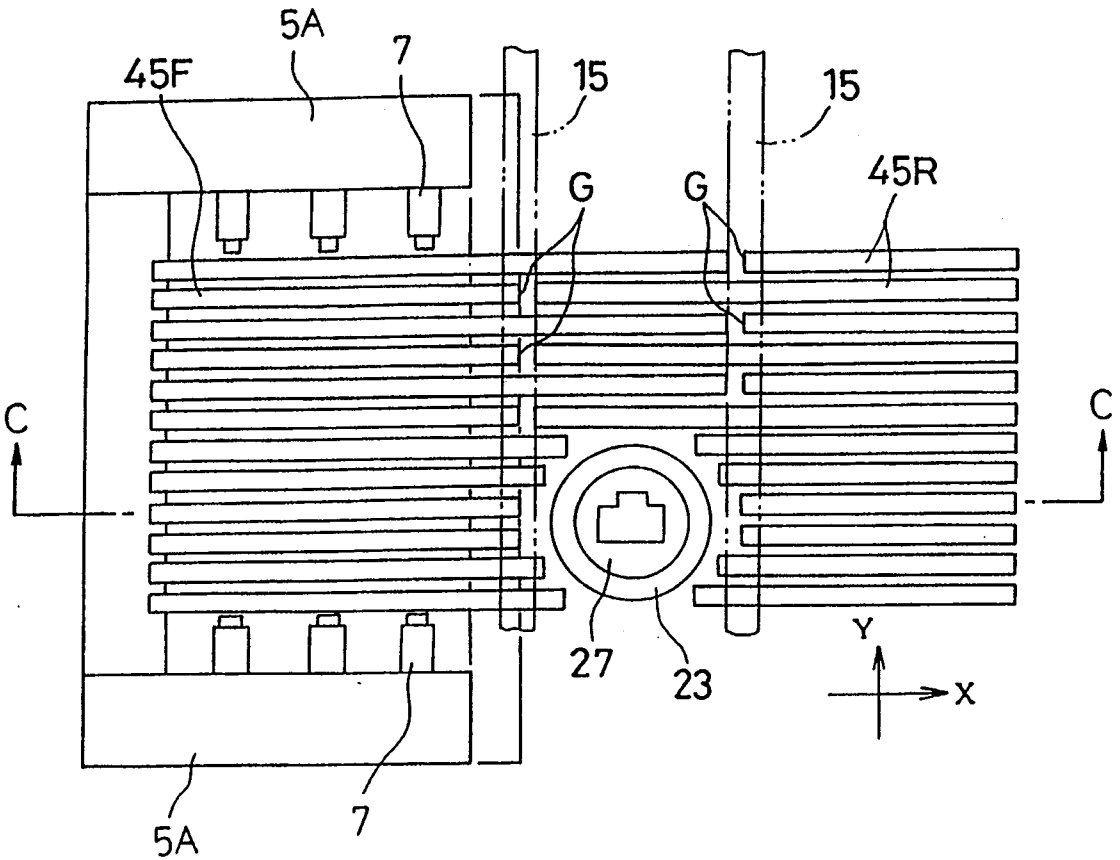
FIG. 6A is a plane view showing the third embodiment shown in FIG. 5.
Figure 6B:
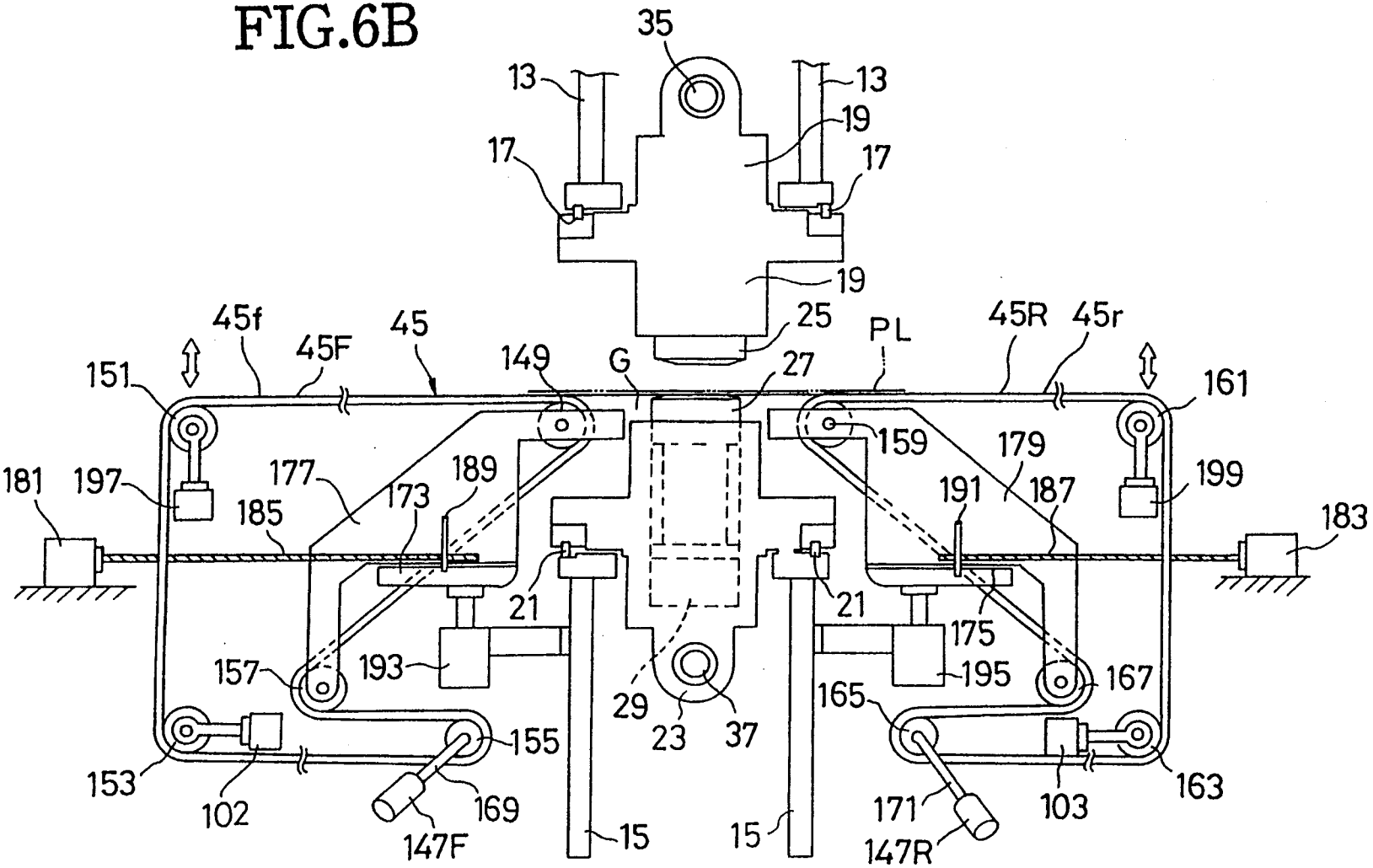
FIG. 6B is a cross-sectional view taken along the line C—C shown in FIG. 5.

With reference to FIGS. 6A to 6C, the essential portions of the work table apparatus will be described in further details hereinbelow. The work table apparatus is provided with a plurality of work supporting belts 45 arranged within the table bed member 1 being divided in the Y-axis direction perpendicular to the X-axis direction along which the plate material to be processed W is moved by the work carriage slider 5A. In other words, a number of work supporting belts 45 are arranged at regular intervals and in parallel to each other in the Y-axis direction of the coordinates.

Further, being different from the first and second embodiments, in this embodiment, each of the work supporting belts 45 is divided into two belts of a front side work supporting belt 45F and a rear side work supporting belt 45R independently, and further the front side work supporting belts 45F are driven by a first drive motor 147F, simultaneously and the rear side work supporting belts 45R are driven by a second drive motor 147R, simultaneously.

The front and rear work supporting belts 45F and 45R are endless belts having a predetermined width and formed of flexible belt-shaped material such as rubber, respectively. The front side work supporting belts 45F are driven round via 5 pulleys 149, 151, 153, 155, and 157 by the first drive motor 147F linked with a drive shaft 169 of the pulleys 155, respectively. The rear side work supporting belts 45R are driven round via 5 pulleys 159, 161, 163, 165 and 167 by the second drive motor 147R linked with a drive shaft 171 of the pulley 165*s*, respectively.

In more detail, the pulleys 149 and 157 of each of the front side work supporting belts 45F are rotatably supported by a movable pulley support member 177 disposed on the left side (in FIGS. 6B and 6C) of the lower frame 15 so as to be shiftable in the X-axis direction of the coordinates along a guide member 173. In the same way, the pulleys 159 and 167 of each of the rear side work supporting belts 45R are rotatably supported by a movable pulley support member 179 disposed on the right side (in FIGS. 6B and 6C) of the lower frame 15 so as to be shiftable in the X-axis direction of the coordinates along a guide member 175. The pulleys 151 and 153 are arranged on the left side of the table bed member 1 (in FIGS. 6B and 6C), and the pulleys 161 and 163 are arranged on the right side of the table bed member 1 (in FIGS. 6B and 6C). The front side work supporting belts 45F are disposed extending horizontally along the work pass line PL between the pulleys 151 and 149 so as to form a front side work table surface movable in the X-axis direction of the coordinates. The rear side work supporting belts 45R are disposed extending horizontally along the work pass line PL between the pulleys 159 and 161 so as to form a rear side work table surface movable in the X-axis direction of the coordinates. Here, the area of each of the front side work supporting belts 45F between the pulleys 151 and 149 is referred to as a front side work support portion 45*f* and the area of each of the rear side work supporting belts 45R between the pulleys 159 and 161 is referred to as a rear side work support portion 45*r*.

Each of the movable pulley support members 177 is disposed for each of the front side work supporting belts 45F and each of the movable pulley support members 179 is disposed for each of the rear side work supporting belts 45R. In the same way, a pair of the pulleys 149 and 157 are disposed for each movable pulley support member 177 and a pair of the pulleys 159 and 167 are disposed for each movable pulley support member 179. Each of the movable pulley support members 177 and 179 is formed with a nut member 189 and 191, respectively. Each of the nut members 189 and 191 is linked with each of fixed servomotors 181 and 183 via each of ball screws 185 and 187 extending in the X-axis direction and in mesh with each of the nut members 185 and 187 fixed to each of the movable pulley support members 177 and 179, respectively.

Therefore, when the movable pulley support member 177 is moved in the X-axis direction of the coordinates along the guide member 173 by the servomotor 181 via the nut member 189, the pulleys 149 and 157 can be also shifted in the same X-axis direction, in order to adjust the length of the front side work support portion 45*f*. Further, when the movable pulley support member 179 is moved in the X-axis direction of the coordinates along the guide member 175 by the servomotor 183 via the nut member 191, the pulleys 159 and 167 can be also shifted in the same X-axis direction, in order to adjust the length of the rear side work support portion 45*r*.

Figure 8A:
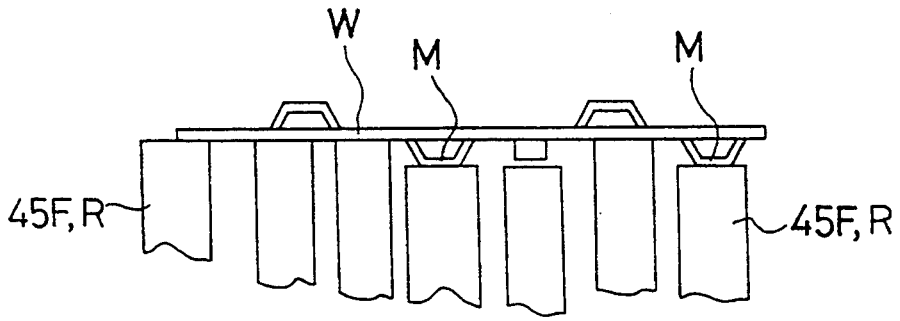
FIG. 8A is a partial enlarged side view for assistance in explaining a first example of the downward formed projections processed by the work table apparatus of the plate material processing machine according to the present invention.
Figure 8B:
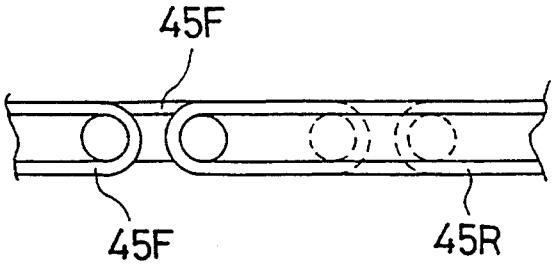
FIG. 8B is a partial enlarged cross-sectional view showing the arrangement of the front side work support portions and the rear side work support portions of the work supporting belts.

The movable pulley support members 177 and 179 are shifted by the respective servomotors 181 and 183 in the X-axis direction, in order to prevent the interference of the movable pulley support members 177 and 179 with the lower die carrier member 23 caused when the lower die carrier member 23 is moved in the Y-axis direction. FIG. 6B shows the state where the pulleys 149 for the front side work supporting belts 45F and the pulleys 159 of the rear side work supporting belts 45R are arranged near the lower die carrier member 23 being shifted a distance away from each other in the X-axis direction with the lower die carrier member 23 interposed between the front side and rear side work support portions 45*f* and 45*r*. Further, as shown in FIG. 6A, there inevitably exist some gaps G between the two pulleys 149 and 159 at which both the front and rear side work supporting belts 45F and 45R are not present. In order to prevent the plate material W to be processed from dropping through the gaps G, in the same way as in the first embodiment, the two adjacent front and rear side belts 45F and 45R are arranged alternately in zigzag fashion along the Y-axis direction so as to be shifted in the X-axis direction, as shown in FIGS. 6A and 8B, so that the gaps G formed between the two front side and rear side work supporting belts 45*f* and 45*r* are not formed continuously in a straight line along the Y-axis direction, as shown in FIG. 6A.

Therefore, when the movable pulley support members 177 and 179 are shifted in the X-axis direction, the pulleys 149 and 159 are also shifted in the same X-axis direction. Under these conditions, when the distances between the pulleys 149 and 159 are adjusted in the X-axis direction, the front side work supporting belts 45F between the pulleys 149 and 157 and the rear side work supporting belts 45R between the pulleys 159 and 167 are moved around under the lower die carrier member 23.

The guide members 173 and 175 are linked with up-down hydraulic cylinder devices 193 and 195, respectively so as to be moved up and down. The pulleys 151 and 161 are linked with other up-down hydraulic cylinder devices 197 and 199, respectively also so as to be moved up and down. By moving the guide members 177 and 179 and the pulleys 151 and 161 synchronously with these up-down hydraulic cylinder devices 193, 195 and 197, 199, respectively. It is possible to move vertically the respective front side work support portions 45*f* and the respective rear side work support portions 45*r* of the front and rear side work supporting belts 45F and 45R, respectively and independently between an upward position corresponding to the pass line PL and a downward position about 30 mm downward away from the upward position, under the condition that the respective front and rear side work supporting belts 45F and 45R are kept horizontally.

Each of the respective pulleys 153 is linked to a belt tension maintaining hydraulic cylinder 102 so as to be shiftable in the X-axis direction. Therefore, the tension of each of the respective front side work supporting belts 45F can be kept at a predetermined constant value by the displacement of each pulley 153 in the X-axis direction caused by the belt tension maintaining hydraulic cylinder 102, irrespective of the movements of the other pulleys 149, 151, 153, 155, and 157.

Each of the respective pulleys 163 is linked to a belt tension maintaining hydraulic cylinder 103 so as to be shiftable in the X-axis direction. Therefore, the tension of each of the respective front side work supporting belts 45R can be kept at a predetermined constant value by the displacement of each pulley 163 in the X-axis direction caused by the belt tension maintaining hydraulic cylinder 103, irrespective of the movements of the other pulleys 159, 161, 163, 155, and 167.

The operation of the double surface formation processing machine provided with the work table apparatus constructed as described above will be described hereinbelow.

First, a plate material W to be processed is set to the work carriage slider 5A with the use of the work clamps 7. Therefore, the plate material W to be processed is fixed to the work carriage slider 5A and further brought into contact with the surfaces of the front side work support portions **45*f* of the front side work supporting belts 45F and the rear side work support portions 45*r* of the respective rear side work supporting belts 45R positioned at the upward position. That is, the plate material W mounted on the respective front and rear side work supporting portions 45*f* and 45*r*** is supported horizontally at a height position of the work pass line PL.

When the work carriage slider 5A is moved in the X-axis direction by the X-axis servomotor 9A, the plate material W supported by the work carriage slider 5A is also moved in the X-axis direction along the work pass line PL. When the upper die carrier member 19 and the lower die carrier member 23 are moved in the Y-axis direction by the Y-axis servomotor 31, the upper die 25 of the upper die carrier member 19 and the lower die 27 of the lower die carrier member 23 are also moved in the Y-axis direction to locate both the upper and lower dies 25 and 27 at a predetermined position relative to the plate material W at which the plate material can be processed such as punching.

When the work carriage slider 5A is being moved in the X-axis direction, since the respective front side work supporting belts 45F are moved along the pulleys 149, 151, 153, 155 and 157 by the first drive motor 147F in synchronism with the movement of the work carriage slider 5A in the X-axis direction and further the respective rear side work supporting belts 45R are moved along the pulleys 159, 161, 163, 165 and 167 by the second drive motor 147R in synchronism with the movement of the work carriage slider 5A in the X-axis direction, the front side work support portions **45*f* and the rear side work support portions 45*r* of the respective front side and rear side work supporting belts 45F and 45R move in the same X-axis direction at the same speed as that of the work carriage slider 5A, respectively in synchronism with the movement of the plate material W supported by the work carriage slider 5A**.

In other words, when the plate material W is moved in the X-axis direction, since no relative displacement is produced between the plate material W and the work table surface of the front and rear side work support portions **45*r* and 45*r* of the front and rear side work supporting belts 45F and 45R on which the plate material W is supported, the plate material W will not slide on and along the work table surface (the front and rear side work support portions 45*f* and 45*r***), thus it being possible to prevent the plate material W from being scratched.

Further, when the plate material W is moved in the X-axis direction, since the lower die 27 of the lower die carrier member 23 is moved down below the work pass line PL by the die up-down actuator 29, it is possible to prevent the contact between the plate material W and the lower die 27, thus preventing the plate material W from being scratched.

The front side work support portions **45*f* and the rear side work support portions 45*r* of the respective front and rear work supporting belts 45F and 45R** are always kept horizontally at the upward position of the pass line PL when the plate material W is being moved and also being processed. Therefore, it is possible to prevent the plate material W is curved downward by the weight of a plurality of punching dies, thus it being possible to prevent the processing precision from being degraded or the microjoint portions from being damaged.

When the plate material W is processed for downward formation such as burring formation, lance formation, louver formation, etc., the lower die 27 fixed to the lower die carrier member 23 is lowered by the die up-down actuator 29 by a height distance corresponding to that of the downward formed portion M. Further, after the downward formation processing has been completed, as depicted in FIG. 8A, the respective guide members 173 and 175 and the respective pulleys 151 and 161 are moved down by the respective up-down hydraulic cylinder devices 193, 195 and 197, 199, respectively belonging to the respective front and rear side work supporting belts 45F and 45R corresponding to the positions at which the downward formed portions M (due to burring, lance, louver, etc,) are formed in the plate material W. Consequently, it is possible to prevent the interference between the front and rear side work support portions **45*f* and 45*r* of the front and rear side work supporting belts 45F and 45R and the downward formed portions M. The front and rear side work supporting belts 45F and 45R** corresponding to the positions of the downward formed portions M can be selected and designated in accordance with an NC program previously prepared before the downward formation processing.

As far as the plate material W clamped in the work carriage slider 5A is not removed from the work carriage slider 5A, the plate material W is not dislocated from the front and rear side work support portions **45*f* and 45*r* of the front and rear side work supporting belts 45F and 45R in both the X- and Y-axis directions. After the front and rear side work support portions 45*f* and 45*r* of the front and rear side work supporting belts 45F and 45R corresponding to the positions of the downward formed portions M are lowered, these lowered portions 45*f* and 45*r* of the work supporting belts 45 support the downward formed portions M of the plate material W. In this case, when the downward formed portions M of the plate material W are being processed, since the front and rear side work support portions 45*f* and 45*r* of the work supporting belts 45** corresponding to the positions other than the downward formed portions M support the plate material W, it is possible to stably support the plate material W horizontally at a height position of the work pass line PL.

The downward distances of the front and rear side work support portions **45*f* and 45*r* of the work supporting belts 45 corresponding to the positions of the downward formed portions M can be determined according to the respective formation heights of the corresponding downward formed portions M. In FIG. 8A, the downward formed portions M are supported by both the front and rear side work support portions 45***f* and 45*r*, respectively.

Further, when the plate material W is processed so as to form upward burring, lance, louver, etc., it is of course unnecessary to move down the front and rear side support portions 45*f* and 45*r* of the work supporting belts 435.

When the upper die carrier member 19 and the lower die carrier member 23 are moved in the Y-axis direction by the Y-axis servomotor 31, the movable pulley support members 177 can be moved in the leftward direction in FIG. 6B by the servomotor 181 and further the movable pulley support members 179 can be moved in the rightward direction in FIG. 6B by the servomotor 183 according to the necessity, so that the lower die carrier member 23 can move through between the pulleys 149 of the front side work support portions 45*f* of the front side work supporting belts 45F moved in the leftward direction and the pulleys 159 of the rear side work support portions 45*r* of the rear side work supporting belts 45R moved in the rightward direction.

In other words, since the spaces between the pulleys 149 of the front side work support portions 45*f* and the pulleys 159 of the rear side word support portions 45*r* can be increased to such an extent that the lower die carrier member 23 can pass therebetween, it is possible to move the lower die carrier member 23 in the Y-axis direction without being subjected to the interference with the front and rear side work support portions 45*f* and 45*r* of the front and rear side work supporting belts 45F and 45R.

After the lower die carrier member 23 has been moved in the Y-axis direction, the movable pulley support members 177 and 179 for the front and rear side work supporting belts 45F and 45R moved to widen the spaces between the pulleys 149 and 159 are both returned to the original positions, respectively, so that the spaces between the pulleys 149 of the front side work support members 45*f* and the pulleys 159 of the rear side work support members 45*f* are returned to the original gap G.

Figure 7:
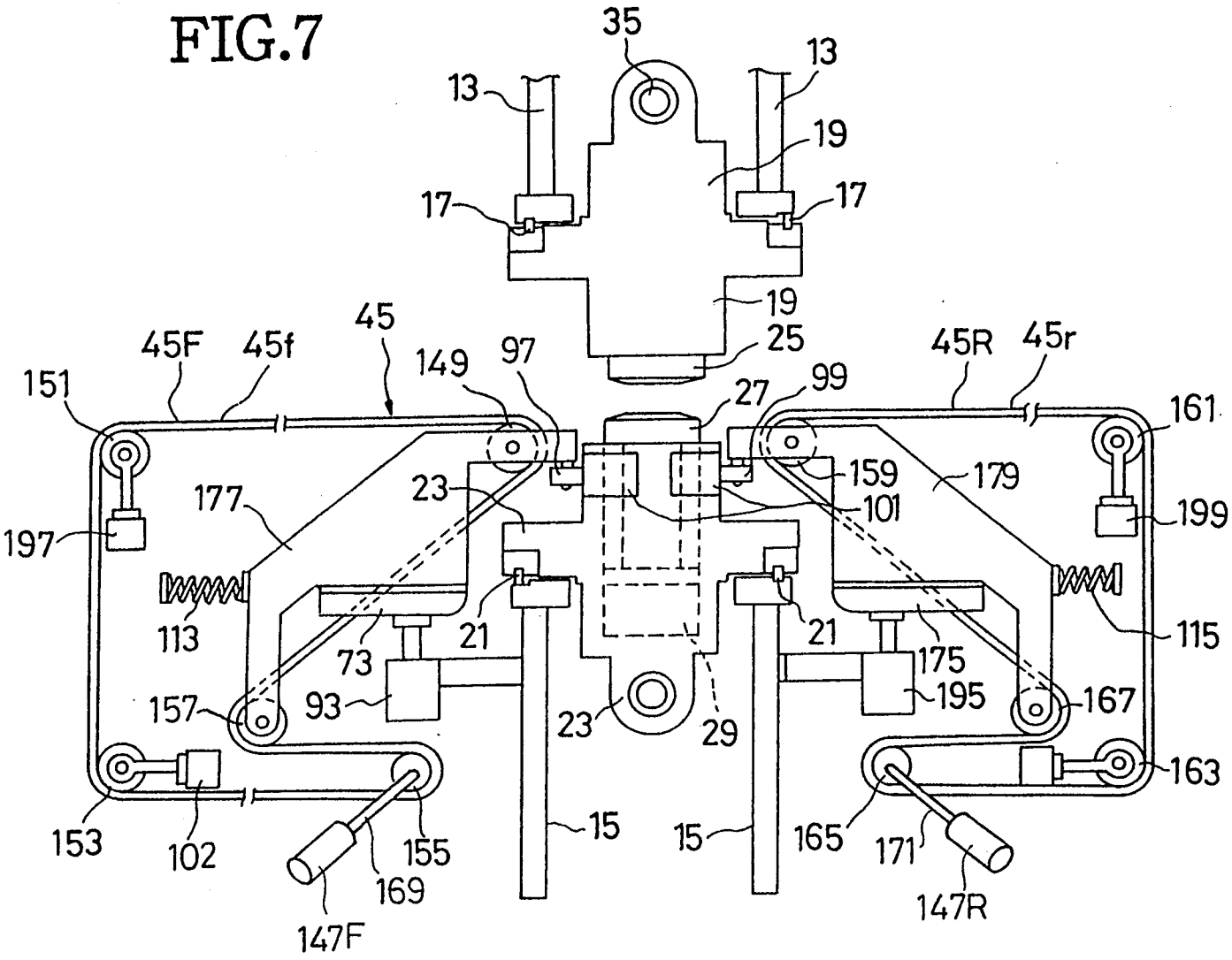
FIG. 7 is a cross-sectional view showing a fourth embodiment of the work table apparatus of the plate material processing machine according to the present invention.

A fourth embodiment of the work table apparatus of the present invention will be described hereinbelow with reference to FIG. 7. The structural features and the functional effects of this fourth embodiment are substantially the same as with the case of the third embodiment previously described, except that two respective movable pulley support members 177 and 179 are urged toward each other by two respective springs 113 and 115 so that cam follower rollers 97 attached to inner ends of the pulley support members 177 can be brought into contact with a cam member 101 attached to the lower die carrier member 23 and similarly cam follower rollers 99 attached to inner ends of the pulley support members 179 can be brought into contact with the same cam member 101. Therefore, the same reference numerals as in the third embodiment shown in FIG. 6B have been retained for the similar parts or sections which have the same functions without repeating any detailed description thereof.

In this embodiment, the springs 113 and 115 are provided instead of the servomotors 181 and 183 shown in FIG. 6B. The cam follower rollers 97 are rotatably attached to the movable pulley support members 177 and the cam follower rollers 99 are rotatably attached to the movable pulley support members 179 respectively, as shown in FIG. 7. Further, a tapering rhombical (diamond-shaped) cam member 101 extending in the Y-axis direction is fixedly attached to the lower die carrier member 23 as shown in FIG. 3B. The respective cam follower rollers 97 and 99 are brought into contact with the respective side portions of the two equilateral triangles of the rhombical cam member 101 by the elastic forces of the respective springs 113 and 115, because the springs 113 and 115 push the movable pulley support members 177 and 179 toward the lower die carrier member 23, respectively. The cam follower rollers 97 and 99 are attached to the respective movable pulley support members 177 and 179 at the height position of the cam member 101.

In this embodiment, the cam follower rollers 97 and 99 of the front and rear side work supporting belts 45F and 45R corresponding to the positions at which the lower die carrier member 23 is not present are directly brought into contact with each other by the elastic forces of the springs 113 and 115, so that the spaces between the pulleys 149 of the front side work supporting belts 45F and the pulleys 159 of the rear side work supporting belts 45R are kept at the minimum gaps.

In contrast with this, the respective cam follower rollers 97 and 99 of the front and rear side work supporting belts 45F and 45R corresponding to the positions at which the lower die carrier member 23 is present are brought into contact with the circumferential wall surface of the lower die carrier member 23 and the side portions of the equilateral triangles of the cam member 101 by the elastic forces of the springs 113 and 115, so that the lower die carrier member 23 is located between the pulleys 149 of the front side work support portions 45*f* of the front side work supporting belts 45F and the pulleys 159 of the rear side work support portions 45*r* of the rear side work supporting belts 45R.

When the upper die carrier member 19 and the lower die carrier member 23 are moved in the Y-axis direction by the Y-axis servomotor 31, the cam member 101 is moved in contact with the cam follower rollers 97 of the movable pulley support members 177 and the cam follower rollers 99 of the movable pulley support members 179, without being removed away from the respective cam follower rollers 97 and 99.

Since the vertical width of the cam surface of the cam member 101 is sufficiently wide (e.g. 35 to 40 mm), the spaces between the pulleys 149 of the front side work support portions 45*f* of the work supporting belts 45 and the pulleys 159 of the rear side work support portions 45*f* thereof can be maintained even when the lower die carrier member 23 is moved, so that it is possible to move the lower die carrier member 23 in the Y-axis direction without any interference of the lower die carrier member 23 with the front and rear side work support portions 45*f* and 45*r* of the work supporting belts 45.

Further, in this embodiment, since the front side work support portions 45*f* and the rear side work support portions 45*r* of the front and rear side work supporting belts 45F and 45R can be moved down independently for each work supporting belt 45, it is possible to realize the same functions and to obtain the same effects as with the case of the third embodiment when the plate material W is processed for downward formation.

In the above-mentioned embodiments, the plate material W to be processed is fixed to the work carriage slider 5A with the use of the clamps and then moved in the X-axis direction. Without being limited thereto, however, it is possible to move the plate material W directly mounted on the front and rear side work support portions 45*f* and 45*r* of the front and rear work supporting belts 45F and 45R in the X-axis direction, without use of the work carriage slider 5A.

As described above, in the work table apparatus for a plate material processing machine according to the present invention, since the work support portions of the work supporting belts can support the plate material horizontally and continuously in the work movement direction in synchronism with the movement of the plate material, no relative displacement is produced between the work support portions of the work supporting belts and the plate material to be processed. Consequently, it is possible to securely support even punched produces of small size, without damaging the microjoint portions of the processed products, scratching the plate material, and producing sound noise.

Further, since the work support portions of the work supporting belts can be lowered selectively from the work pass line, it is possible to form downward projecting portions in the plate material and further to support the downward formed projecting portions by the lowered work support portions of the work supporting belts, thus preventing the downward deflection of the processed plate material.

Further, since the work support portions of the work supporting belts are moved by the servomotors or urged by the springs horizontally toward the plate material processing section, it is possible to effectively support the plate material by reducing as small as possible the area at which the plate material is not supported by the belts.

Further, since the front and rear side work support portions of the front and rear side work supporting belts are driven independently, it is possible to carry out the both-surface processed products from the rear side work supporting belts.

As shown in FIGS. 6A and 8B, the front and rear side work support belts 45F, 45R are arranged in such a way to alternately extend across the punch head 19. With this arrangement, a small or thin workpiece, or a workpiece having a shape of a picture frame can be smoothly transported by the belts 45F, 45B.

What is claimed is:

1. A work table apparatus for a plate material processing machine having a plate material processing section, for movably supporting a plate material to be processed in a first direction along a work pass line, comprising:

(a) a group of work supporting belts each extending in the first direction and arranged separately in a second direction perpendicular to the first direction;

(b) belt driving means for driving said work supporting belts in the first direction of the work pass line;

(c) downward belt moving means for selectively moving one of the work supporting belts downward away from the work pass line.

2. The work table apparatus for a plate material processing machine of claim 3, wherein the work supporting belts include a front side work support portion on a front side of the plate material processing section, and a rear side work support portion on a rear side of the plate material processing section.

3. The work table apparatus for a plate material processing machine of claim 2, which further comprises a horizontal belt moving means for moving the front and rear side work support portions of said work supporting belts horizontally toward the plate material processing section to reduce gaps between two opposing inner ends of the front and rear side work support portions.

4. The work table apparatus for a plate material processing machine of claim 3, wherein said horizontal belt moving means comprises:

(a) a work table bed member;

(b) front and rear guide members provided for each work supporting belt and fixed to said work table bed member;

(c) front and rear movable pulley support members provided for each work supporting belt and slidably supported by said front and rear guide members, respectively;

(d) a first group of pulleys provided for each work supporting belt and rotatably supported by said from movable pulley support members;

(e) a second group of pulleys provided for each work supporting belt and rotatably supported by said rear movable pulley support members;

(f) a third group of pulleys provided for each work supporting belt and rotatably supported by a front section of the work table bed member; and (g) a fourth group of pulleys provided for each work supporting belt and rotatably supported by a rear section of the work table bed member;

(h) two nut members fixed to said front and rear guide members, respectively;

(i) two servomotors fixed to said front and rear movable pulley support members, respectively; and (j) two ball screws attached to said servomotors and engaged with said two nut members, respectively, to move said front and rear movable pulley support members horizontally along said guide members, respectively, when rotated by said servomotors.

5. The work table apparatus for a plate material processing machine of claim 4, wherein both inner ends of the front side work support portions and the rear side work support portions of said work supporting belts are arranged alternately in zigzag fashion so as not to form a straight gap space between both the inner ends thereof.

6. The work table apparatus for a plate material processing machine of claim 3, said horizontally moving belt moving means comprising:

(a) a work table bed member;

(b) front and rear guide members provided for each work supporting belt and fixed to said work table bed member;

(c) from and rear movable pulley support members provided for each work supporting belt and slidably supported by said from and rear guide members, respectively;

(d) a first group of pulleys provided for each work supporting belt and rotatably supported by said from movable pulley support members;

(e) a second group of pulleys provided for each work supporting belt and rotatably supported by said rear movable pulley support members;

(f) a third group of pulleys provided for each work supporting belt and rotatably supported by a from section of the work table bed member; and (g) a fourth group of pulleys provided for each work supporting belt and rotatably supported by a rear section of the work table bed member;

(h) a cam member fixed to the plate material processing section;

(i) two front and rear cam follower rollers provided at a left side and a right side for each work supporting belt and rotatably attached to inner ends of said from and rear movable pulley support members, respectively; and (j) two springs provided for each work supporting belt, for urging said left and right cam follower rollers into contact with said cam member fixed to the plate material processing section.

7. The work table apparatus for a plate material processing machine of claim 6, wherein said cam member fixed to the plate material processing section is formed with a diamond-shaped cam surface.

8. The work table apparatus for a plate material processing machine of claim 2, wherein each of said work supporting belts is a single belt; and said belt driving means is a work carriage slider for supporting the plate material to be processed and linked with each of said work supporting belts.

9. The work table apparatus for a plate material processing machine of claim 2, wherein each of said work supporting belts is divided into a front side work supporting belt and a rear side work supporting belt; and said belt driving means includes a first belt driving motor for driving said front side work supporting belts, and a second belt driving motor for driving said rear side work supporting belts, respectively.

10. The work table apparatus for a plate material processing machine of claim 1, which further comprises belt supporting means including:

(a) a work table bed member;

(b) front and rear guide members provided for each work supporting belt and fixed to said work table bed member;

(c) from and rear movable pulley support members provided for each work supporting belt and slidably supported by said front and rear guide members, respectively;

(d) a first group of pulleys provided for each work supporting belt and rotatably supported by said from movable pulley support members;

(e) a second group of pulleys provided for each work supporting belt and rotatably supported by said rear movable pulley support members:

(f) a third group of pulleys provided for each work supporting belt and rotatably supported by a from section of the work table bed member; and (g) a fourth group of pulleys provided for each work supporting belt and rotatably supported by a rear section of the work table bed member.

11. The work table apparatus of claim 10, further comprising a belt tension adjusting means (89; 102, 103).

12. The work table apparatus for a plate material processing machine of claim 10, wherein said belt moving means comprises:

(a) two first up-down hydraulic cylinder devices provided for each work supporting belt, for vertically moving front and rear guide members, respectively; and (b) two second up-down hydraulic cylinder devices provided for each work supporting belt, for vertically moving third and fourth groups of pulleys supporting said supporting belts, respectively.

13. A plate material processing machine comprising:

a plate material processing section; and a work table apparatus for movably supporting a plate material to be processed in a first direction along a work pass line;

wherein a work table includes:

a group of work supporting belts each extending in the first direction and arranged separately in a second direction perpendicular to the first direction; and belt driving means for driving said work supporting belts in the first direction of the work pass line; and downward belt moving means for selectively moving one of the work supporting belts downwardly away from the work pass line.

14. A workpiece table apparatus for a plate material processing machine having a plate material processing section for movably supporting a plate material to be processed in a first direction along a work pass line, comprising:

(a) a group of work supporting belts each extending in the first direction and arranged separately in a second direction perpendicular to the first direction, the work supporting belts including a front side work support portion on a front side of the plate material processing section, and a rear side work support portion on a rear side of the plate material processing section;

(b) belt driving means for driving said work supporting belts in the first direction of the work pass line; and (c) belt moving means for moving the front and rear side work support portions horizontally toward the plate material processing section to reduce gaps between two opposing inner ends of the from and rear side work support portions;

wherein the belt moving means includes an elastic member for urging the front and rear side work support portions toward the plate material processing section.

* * * * *

UNITED STATES PATENT AND TRADEMARK OFFICE

CERTIFICATE OF CORRECTION

PATENT NO. : 5,442,985

DATED : Aug. 22, 1995

INVENTOR(S) : Shigeru Ito

It is certified that error appears in the above-indentified patent and that said Letters Patent is hereby corrected as shown below:

Column 19 (claim 2), line 59, change "3" to --1--.

Column 20 (claim 4), line 16, change "from" to --front--.

Column 20 (claim 6), lines 49, 55 and 60, change "from" to --front--.

Column 21 (claim 6), line 2, change "from" to --front--.

Column 21 (claim 6), line 46, change "from" to --front--.

Signed and Sealed this

Sixteenth Day of December, 1997

Bruce Lehman

*Attest:*

BRUCE LEHMAN

*Attesting Officer*

*Commissioner of Patents and Trademarks*